US011504938B2

(12) United States Patent
Castronovo et al.

(10) Patent No.: US 11,504,938 B2
(45) Date of Patent: Nov. 22, 2022

(54) BIODEGRADABLE STRAWS AND METHODS OF MAKING BIODEGRADABLE STRAWS

(71) Applicants: Bridgette Castronovo, Kennesaw, GA (US); Taylor McNeal, Kennesaw, GA (US)

(72) Inventors: Bridgette Castronovo, Kennesaw, GA (US); Taylor McNeal, Kennesaw, GA (US)

( * ) Notice: Subject to any disclaimer, the term of this patent is extended or adjusted under 35 U.S.C. 154(b) by 134 days.

(21) Appl. No.: 17/139,315

(22) Filed: Dec. 31, 2020

(65) Prior Publication Data

US 2022/0203646 A1 Jun. 30, 2022

(51) Int. Cl.

| | |
|---|---|
| ***B31D 5/00*** | (2017.01) |
| ***A47G 21/18*** | (2006.01) |
| ***D21H 21/28*** | (2006.01) |
| ***D21H 19/18*** | (2006.01) |
| ***D21H 17/25*** | (2006.01) |
| ***D21H 11/12*** | (2006.01) |

(52) U.S. Cl.

CPC ..... *B31D 5/0095* (2013.01); *A47G 21/18* (2013.01); *D21H 11/12* (2013.01); *D21H 17/25* (2013.01); *D21H 19/18* (2013.01); *D21H 21/28* (2013.01)

(58) Field of Classification Search

CPC ..... B31D 5/0095; A47G 21/18; D21H 11/12; D21H 17/25; D21H 19/18; D21H 21/28

See application file for complete search history.

(56) References Cited

U.S. PATENT DOCUMENTS

2003/0216492 A1* 11/2003 Bowden ..... C08L 101/16 524/47
2014/0084077 A1* 3/2014 Knight ..... A47G 21/183 137/268
2018/0235390 A1* 8/2018 Lehmann ..... A47G 21/18

FOREIGN PATENT DOCUMENTS

MX 2011005508 A * 11/2012

OTHER PUBLICATIONS

Azevedo, E. P., et al., "Mechanical properties of cellulose: Chitosan blends for potential use as a coronary artery bypass graft", *Journal of Biomaterials Science—Polymer Edition*, 24(3), 239-252 (2013).

Doench, I. et al., "Injectable and Gellable Chitosan Formulations Filled with Cellulose Nanofibers for Intervertebral Disc Tissue Engineering", *Polymers* (20734360), 10(11), 1202 (2018).

Kim, J. et al., "Preparation and characterization of a Bacterial cellulose/Chitosan composite for potential biomedical application", *Journal of Polymer Research*, 18(4), 739-744 (2011).

(Continued)

*Primary Examiner* — Eric Hug
*Assistant Examiner* — Matthew M Eslami
(74) *Attorney, Agent, or Firm* — Kilpatrick Townsend & Stockton LLP

(57) ABSTRACT

Paper products can be made from cellulose derived from corn husks. A method of making paper products may include obtaining corn husks, extracting cellulose fiber pulp from the corn husks, forming a paper sheet from the extracted cellulose fiber pulp, adding a chitosan acetic acid solution having a concentration of at least 5 wt. % chitosan to the paper sheet, forming the paper product from the paper sheet, and coating the paper product with a paraffin wax.

19 Claims, 10 Drawing Sheets

(56) References Cited

OTHER PUBLICATIONS

Mao, H. et al., "Mechanical and Water-Resistant Properties of Eco-Friendly Chitosan Membrane Reinforced with Cellulose Nanocrystals", *Polymers* (20734360), 11(1), 166 (2019).
Wang, S. et al., "Effects of a Chitosan Coating Layer on the Surface Properties and Barrier Properties of Kraft Paper", *BioResources*, 11(1), 1868-1881 (2016).
Zhijiang, C. et al., "Preparation and Characterization of a Bacterial Cellulose/Chitosan Composite for Potential Biomedical Application," J. Applied Polymer Sci. 121:1488-1494 (2011).

* cited by examiner

Wet Chitosan Application, 400x

5% 0%

Dry Chitosan Application, 400x

2% 1%

Wet Chitosan Application, 400x

2% 1%

Blending Study. Before and After Chitosan 20 sec 45 sec

BIODEGRADABLE STRAWS AND METHODS OF MAKING BIODEGRADABLE STRAWS

FIELD

Described herein are cellulose papers, and in particular, coated cellulose papers for forming straws.

BACKGROUND

Pollution caused by accumulating non-biodegradable plastic waste is an enormous environmental issue that plagues bodies of water. More than 8 million metric tons of plastic wash into the oceans each year, including 7.5 million straws. Traditional polymer straws are made with non-biodegradable materials. These materials do not break down completely and can form micro plastic that can cause substantial harm to ocean animals and ecosystems. Biodegradable straws made from paper have been developed. While paper straws are more environmentally friendly than their plastic counterparts, millions of trees must be cut down to make the paper.

SUMMARY

Paper straws made from recycled material or waste products could reduce plastic waste and reduce destruction of trees or forests for paper straws. Described herein are paper straws and methods of making paper straws from cellulose, in particular cellulose derived from corn husks.

In an example, a method of making a paper product may include obtaining corn husks, extracting cellulose fiber pulp from the corn husks, forming a paper sheet from the extracted cellulose fiber pulp, adding a chitosan acetic acid solution having a concentration of at least 5 wt. % chitosan to the paper sheet, forming the paper product from the paper sheet, and coating the paper product with a paraffin wax. In some examples, extracting cellulose fiber pulp from corn husks may include contacting the corn husks with a sodium carbonate solution in a vessel to form a corn husk mixture, heating the corn husk mixture, separating the corn husks from the corn husk mixture, washing the separated corn husks with a first solvent, combining the washed corn husks with a second solvent, cutting the washed corn husks to create a liquid suspension of cellulose fiber pulp, and separating the cellulose fiber pulp from the liquid of the suspension. In some examples, forming the paper sheet may include adding the cellulose fiber pulp to a mold, applying pressure to the cellulose fiber pulp, and dehydrating the cellulose fiber pulp to form the paper sheet. In some examples, forming the paper product may include cutting the paper sheet to dimension, shaping the paper sheet into the formed paper product, and drying the formed paper product. In some examples, a paper tube may be produced by the methods described herein.

These and other examples of the present invention are described in greater detail in the Detailed Description that follows.

DETAILED DESCRIPTION

Figure 1:
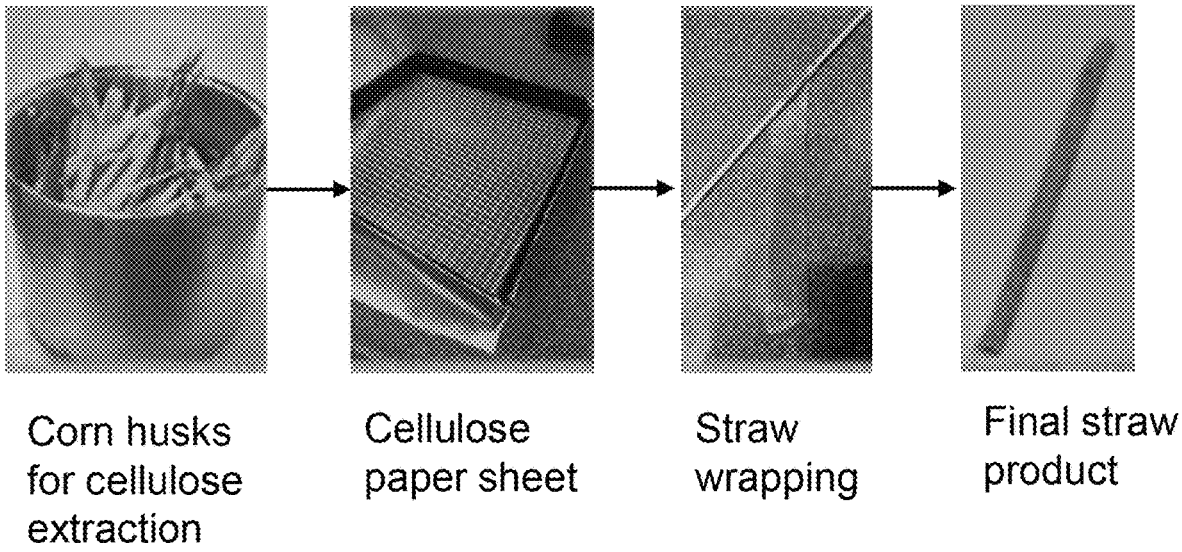
FIG. 1 shows process steps for preparing a cellulose sheet and straw.

Described herein are biodegradable straws made from husks of corn crops, a natural waste product that is an alternative to polymer and paper straws. The straws may have structural integrity for use in liquids and may have an aesthetic design. Shucked husks from corn crops are a prevalent agricultural waste product produced in the United States.

In some examples, straws may comprise cellulose fiber pulp extracted from corn husks, formed into flat sheets. The sheets may be coated with chitosan and paraffin. In some examples, a chitosan solution of 5 wt. % may be used to produce the straws. The chitosan solution may have a concentration greater than 5 wt. % in some examples (e.g., 5.5 wt. % or 7 wt. %). The chitosan may bond with the cellulose fibers to increase durability of the straw. Optionally, different colors or dyes may be added to enhance the aesthetic appearance of the straw.

Described herein are methods of making biodegradable paper products made from husks of corn crops. In some examples, the paper product may be a flat sheet. In other examples, the paper product may have a tubular shape. For example, the paper product may be a drinking straw.

In an example, a method of making a paper product may include obtaining corn husks and extracting cellulose fiber pulp from the corn husks. The corn husks may be waste from farming operations or food service operations. The corn husks may be obtained through post-consumer recycling efforts.

In some examples, extracting cellulose fiber pulp from corn husks may include contacting the corn husks with a sodium carbonate solution in a vessel to form a corn husk mixture and heating the corn husk mixture. The corn husk mixture may be heated to a temperature of at least 95° C. The mixture may be held at temperature. In some examples, the mixture may be agitated during the heat and hold period. In some examples, the hold period may be about 2 hours. In other examples, the hold period may be more than 2 hours. The heated corn husks may be separated from the corn husk/sodium carbonate mixture and washed with a first solvent. The washed corn husks may be combined with a second solvent to be blended or cut into small pieces to create a liquid suspension of cellulose fiber pulp. In some cases, the first or second solvent may be water or an aqueous solution. The amount of the second solvent may be approximately equivalent to the amount of washed corn husks. For example, a weight ratio of the second solvent to the washed corn husks may be from 40:60 to 60:40 (e.g., 50:50). Optionally, a dye or a color additive may be added to the liquid suspension. In some examples, the dye or the color additive may be a food-safe additive.

The cellulose fiber pulp may be separated from the liquid of the suspension using a mesh screen or filter. In some examples, a mesh filter may be placed over a water bath to facilitate paper formation. In some examples, forming the paper sheet may include adding the cellulose fiber pulp to a mold. In some examples, a deckle may be used. To aid in forming paper, pressure may be applied to the cellulose fiber pulp in the mold. In some examples, a cloth or other absorbent material may be placed over the paper. In some examples, a leveling tool may be used to aid in uniform thickness of the cellulose fiber pulp in the mold.

In some examples, a chitosan acetic acid solution having a concentration of at least 5 wt. % chitosan may be added to the paper sheet. Chitosan may have advantageous properties such as non-toxicity, antimicrobial properties, and biocompatibility. In certain examples, the concentration of the chitosan may exceed 5% in the solution. The chitosan acetic acid solution may be sprayed on the paper sheet. In some examples, the paper sheet may be dipped in the chitosan acetic acid solution. The chitosan solution may improve durability of the paper sheet or final paper product. The paper sheet may be dehydrated for use or additional processing.

In some examples, the sheet may be cut to product dimensions and shaped to form the paper product before dehydration. In some examples, forming the paper product may include cutting the paper sheet to dimension. The paper may be cut into strips having a length several times greater than width of strip. In some examples, the paper sheet may have a thickness of about 0.5 mm to 1.0 mm.

The paper sheet or cut paper may be shaped into a formed paper product. The paper sheet may be rolled on a form or other means known by those skilled in the art to form the paper product. The formed product may be dried. Optionally, the dried to product may be coated to aid in use in liquid contact applications. In some examples, the paper product may be coated with a paraffin wax or other suitable wax.

In some examples, a paper tube may be produced by the methods described herein. The tube may be used for drinking straws.

EXAMPLES

The following steps were used to prepare cellulose sheets. FIG. 1 shows examples of the preparation steps. Husks were removed from 12 ears of corn. A sodium carbonate solution was prepared by mixing 2 gallons of water and 8 tablespoons of sodium carbonate. The husks were processed by placing the husks in a vessel with the sodium carbonate solution. The sodium carbonate solution and husks were heated to a boil and allowed to simmer using low heat for 2 hours. The processed husks were removed from the sodium carbonate solution and rinsed thoroughly with water. The processed husks were mixed with equal parts water, along with coloring additives in a blender for 20 seconds. The blending time and color added was varied in the examples.

A basin was filled with water and a mold and deckle with a mesh screen were placed on the surface of the water. The blended husk mixture was poured into the center of the mold and the cellulose pulp from the blended husk mixture was spread over the screen. A tool with a flat edge was used to achieve uniform thickness of the pulp. Once filled, the mold and deckle were lifted and the water allowed to drain and separate from the pulp. The deckle was removed and cotton placed on top of the pulp. Firm pressure was applied to the top of the cotton with a sponge to remove excess water. The mold and cotton were flipped over so the cotton was on the bottom. The mold was removed.

A second cotton sheet was placed over the pulp sheet and a sponge was used to transfer water through the cotton sheet. The steps were repeated until the cellulose sheet was nearly dry.

Chitosan solutions were prepared by dissolving chitosan flakes in water and a 5% acetic acid solution according to the desired experimental chitosan concentration (1 wt. %, 2 wt. %, 5 wt. %). Three concentrations of chitosan solutions were tested to determine preferable concentrations for straw durability. The timing of the chitosan application was varied to test effects of wet versus dry application. For wet application of chitosan, the chitosan solution was sprayed onto the cellulose sheet.

For durability, three 4-inch sections of paper were prepared and coated with chitosan while wet (1 wt. %, 2 wt. %, or 5 wt. % concentration of chitosan respectively). The samples were allowed to dry. Three other 4-inch sections of paper were coated in a 1 wt. %, 2 wt. %, or 5 wt. % chitosan solution after the paper had fully dried. The samples were placed in a cup of water for 30 minutes to observe durability of the paper. The straws were evaluated at 5-minute intervals and were assigned a durability score of 0 to 5 based on functionality and shape maintenance. The results are displayed in Table 1 below. Graphs of the change in durability over time are shown in FIGS. 2 and 3.

TABLE 1

| Time | wet chitosan | | | dry chitosan | | |
|---|---|---|---|---|---|---|
| (min) | 1% | 2% | 5% | 1% | 2% | 5% |
| 0 | 5 | 5 | 5 | 5 | 5 | 5 |
| 5 | 3 | 4 | 4 | 2 | 2 | 2 |
| 10 | 2 | 4 | 4 | 2 | 2 | 2 |
| 15 | 2 | 3 | 3.5 | 2 | 2 | 2 |
| 20 | 2 | 2 | 3 | 2 | 2 | 2 |
| 25 | 1 | 2 | 3 | 1 | 1 | 2 |
| 30 | 1 | 1 | 2 | 1 | 0 | 2 |

Figure 2:
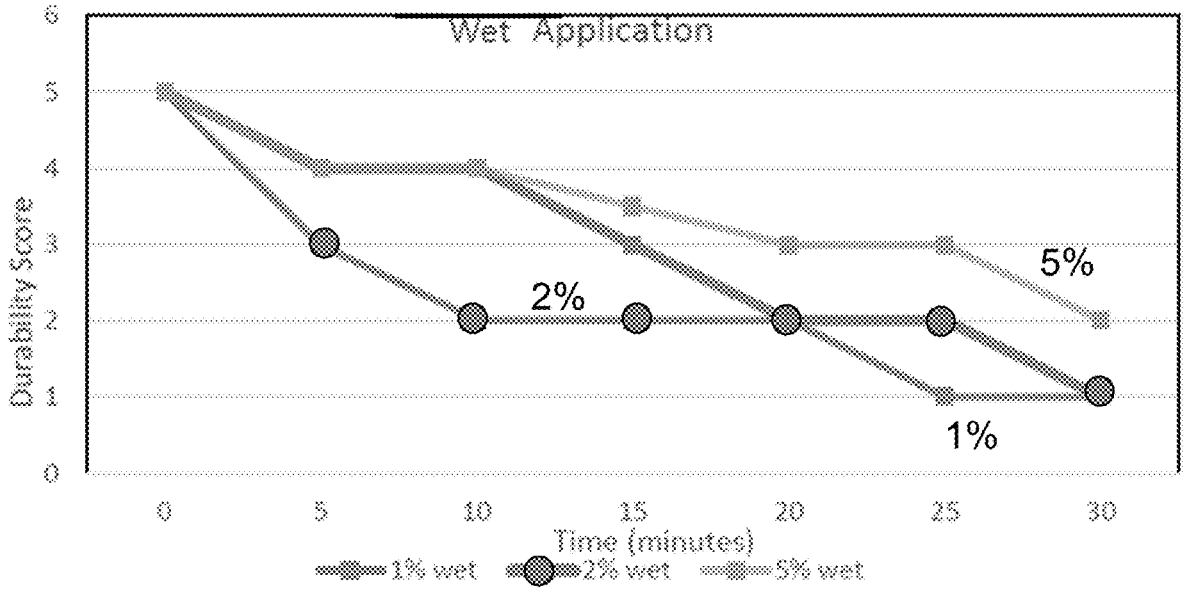
FIG. 2 is a chart of paper durability for wet chitosan application.
Figure 3:
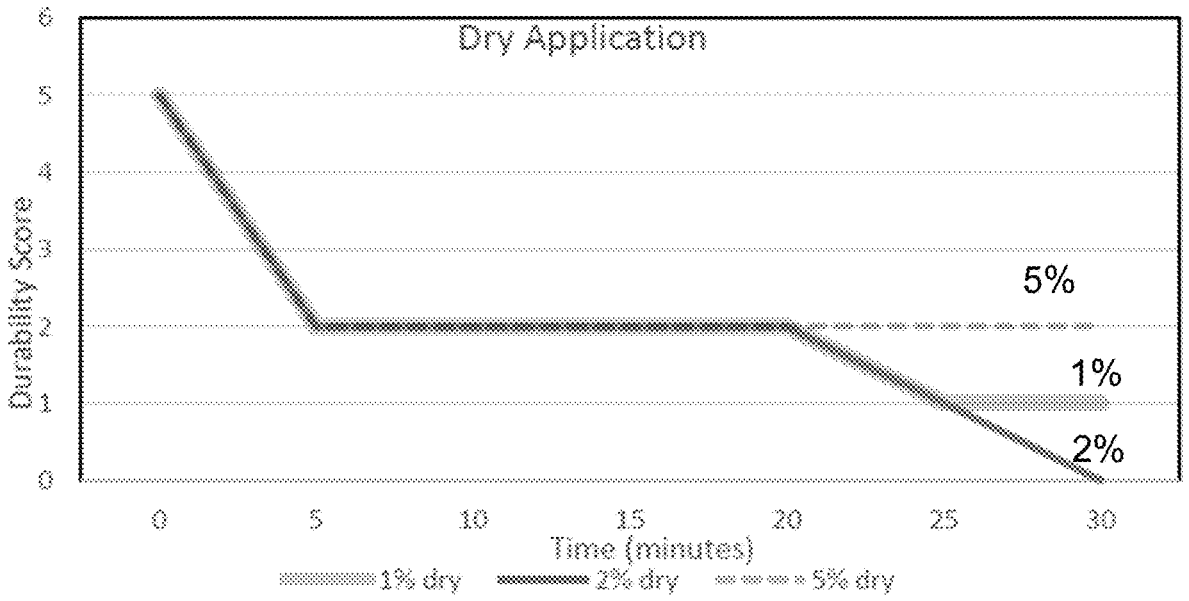
FIG. 3 is a chart of paper durability for dry chitosan application.

As illustrated in FIGS. 1 and 2, changing the concentration of chitosan dissolved in a solution of acetic acid showed variation in the functionality of the straw. Increasing the concentration of chitosan improved the durability of straw in water consistently in both wet and dry applications. The solution containing 5% chitosan performed best as it was tightly bound and relatively firm after soaking in a cup of water for a duration of 30 minutes. The straws that were coated in the 1% and 2% solutions after drying functioned comparatively, but there was a discernable improvement in the functionality of the 1% concentration. The straws with the 1% solutions were observed to be more tightly wrapped than the 2% samples. The straws coated when wet when compared to the straws that were coated after they dried showed increased bonds strength and the cellulose fibers were more tightly bonded together. The straws that were coated while wet remained more durable in water than the straws that were coated after they had dried.

For straws, the cellulose sheets were cut into 1.5 inch by 8 inch strips. A thin skewer was used to roll the strip into a straw shape. The straws were dried overnight. For dry application of chitosan, the straws were dipped into the chitosan solution for 15 seconds. Once the straws were completely dry, a coat of paraffin wax was added. The straws were dipped into the wax and allowed to set.

These designs were evaluated for functionality as well as by microscopy. Variations of blending times for the pulp extraction were tested for durability and sheet uniformity evaluated to determine the impact of changing the cellulose base material.

Figure 4:
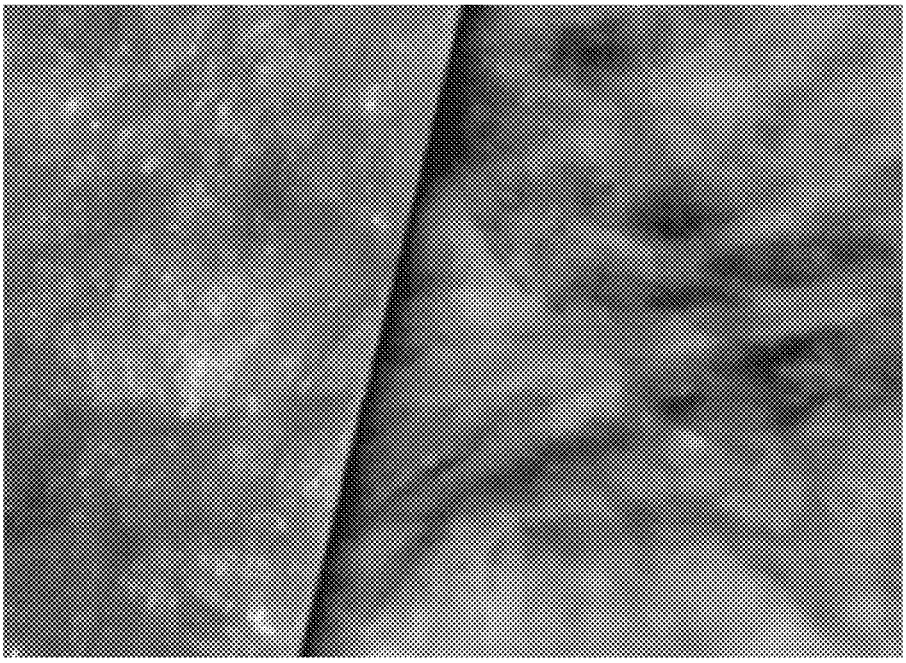
FIG. 4 is a micrograph of paper showing wet chitosan application at 5% versus 0%.

Paper samples were evaluated for microscopic differences based on variable chitosan concentrations and application times. Six samples were prepared, three coated when wet with 1%, 2%, and 5% chitosan concentration and three coated after drying with 1%, 2%, and 5% chitosan concentrations. All samples were evaluated under a microscope at 400× magnification. Observations regarding distribution of fibers, surface roughness, and overall appearance were recorded. As shown in FIG. 4 the surface of the 5% coated sample was smoother and had less variation than the uncoated sample.

Figure 5:
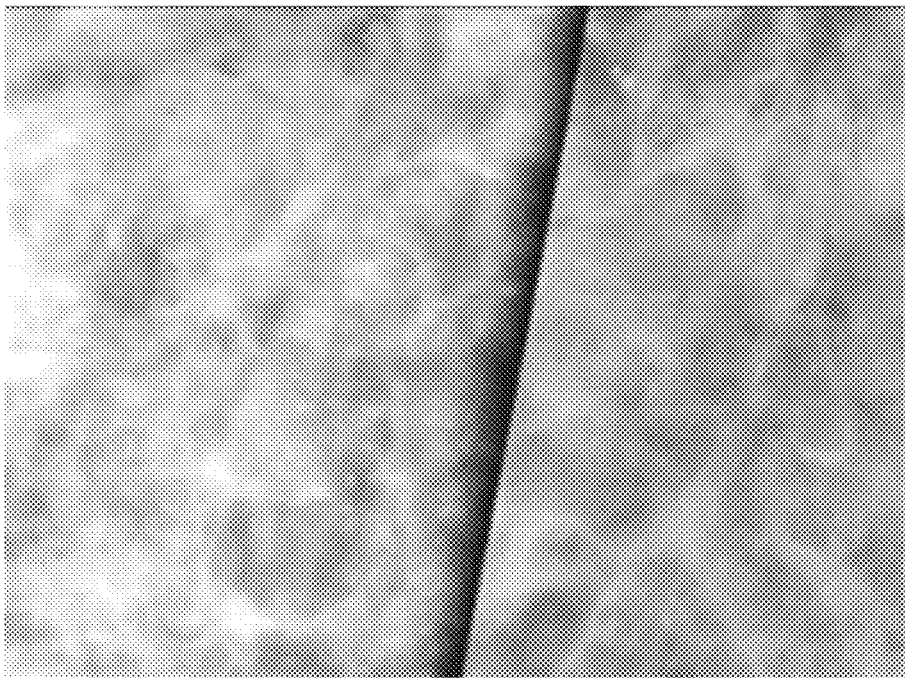
FIG. 5 is a micrograph of paper showing dry chitosan application at 2% versus 1%.
Figure 6:
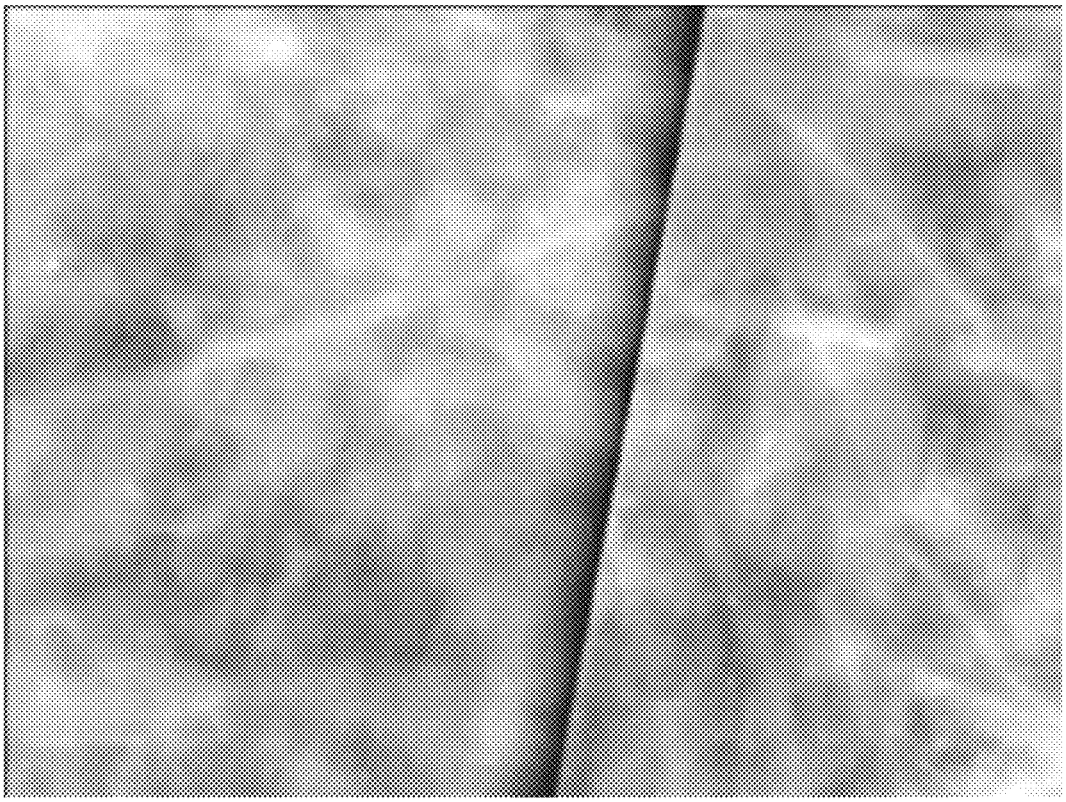
FIG. 6 is a micrograph of paper showing wet chitosan application at 2% versus 1%.

Significant differences were not detected in the surface between the 1% and 2% samples in either the wet or dry application as shown in FIGS. 5 and 6. The chitosan coating on the dry coated samples was observed to be more on the surface and less incorporated than the wet coated samples. Deeper incorporation of chitosan into the cellulose structure may occur for wet application before the cellulose is fully bonded.

Figure 7:
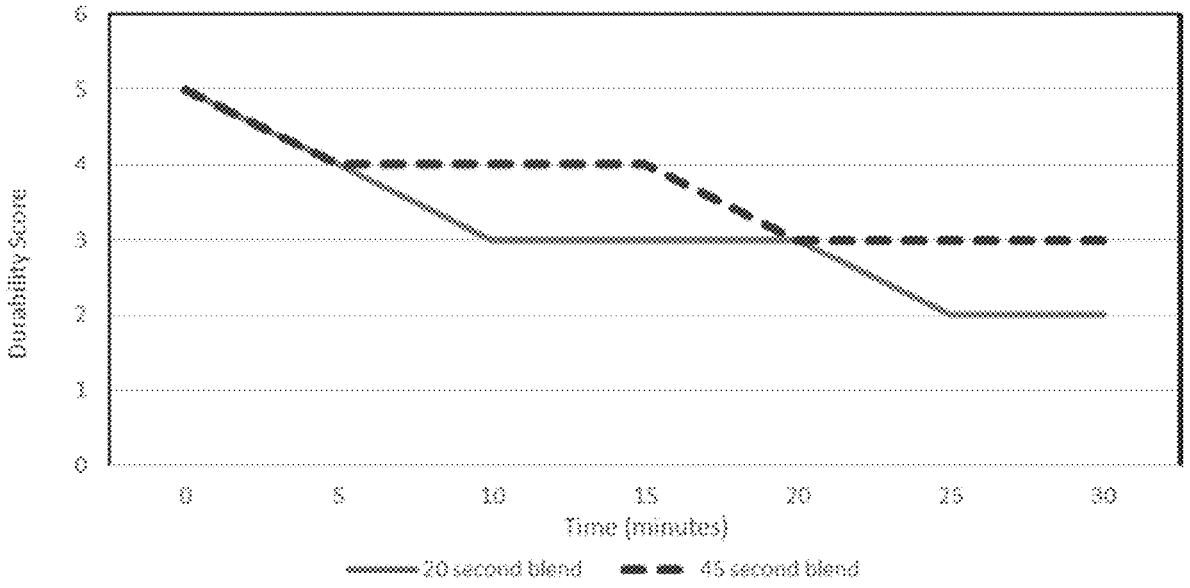
FIG. 7 is a chart of paper durability for varied blending times.
Figure 8A:
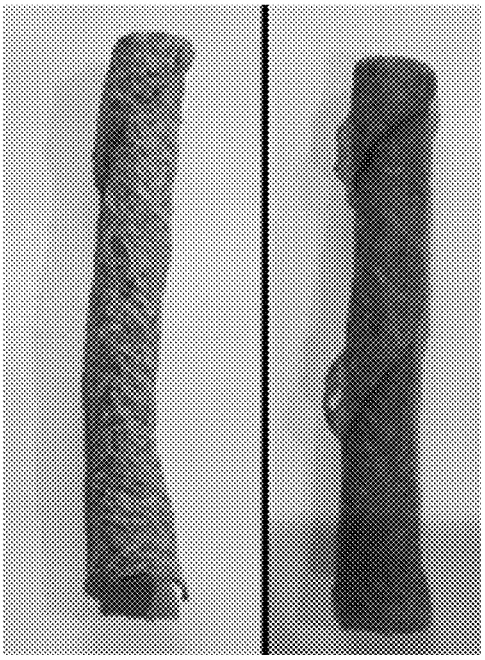
FIGS. 8A and 8B are images of straw samples for varied blending times.
Figure 8B:
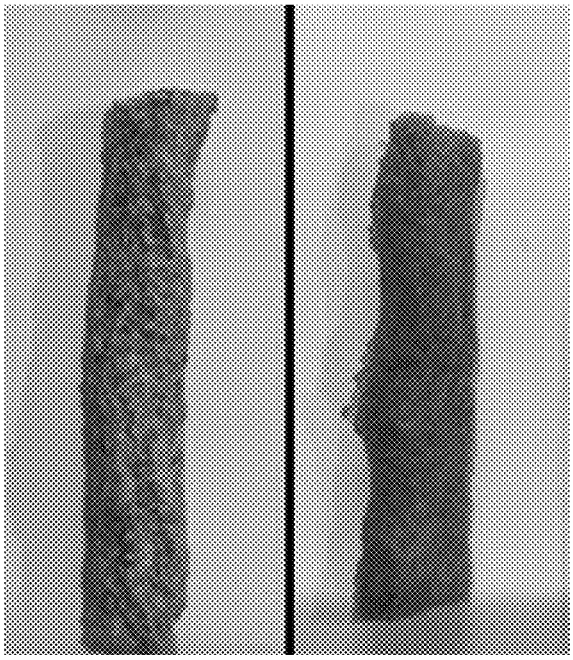

Test straw samples were made from a sheet and processed with a 20 second blend time or a 45 second blend time. Each test straw was submerged in water for 30 minutes and evaluated at 5-minute intervals. A durability score based on functionality and shape retention was recorded at each time point. Both blending speeds produced straws that maintained durability for 30 minutes in water. The 45 second blend time straw exhibited better durability than the 20 second sample as indicated by the longer time before degradation as shown in FIG. 7. After testing, the straws were inspected and an unusual area of collected chitosan was observed on the surface of both samples as evident in FIGS. 8A and 8B. The straws were coated with chitosan after drying and hung horizontally to dry the coating. The chitosan accumulated in drops on the lower side of the straw. The collections of chitosan on the surface had no effect on the functionality of the straw.

Figure 9A:
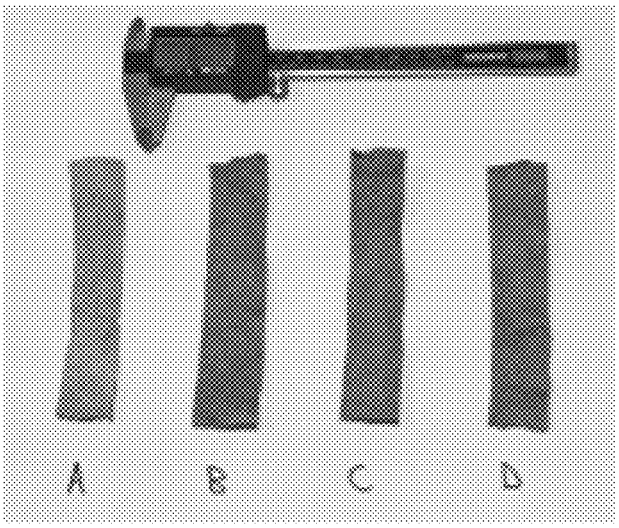
FIG. 9A is a photograph of paper samples for thickness measurements.
Figure 9B:
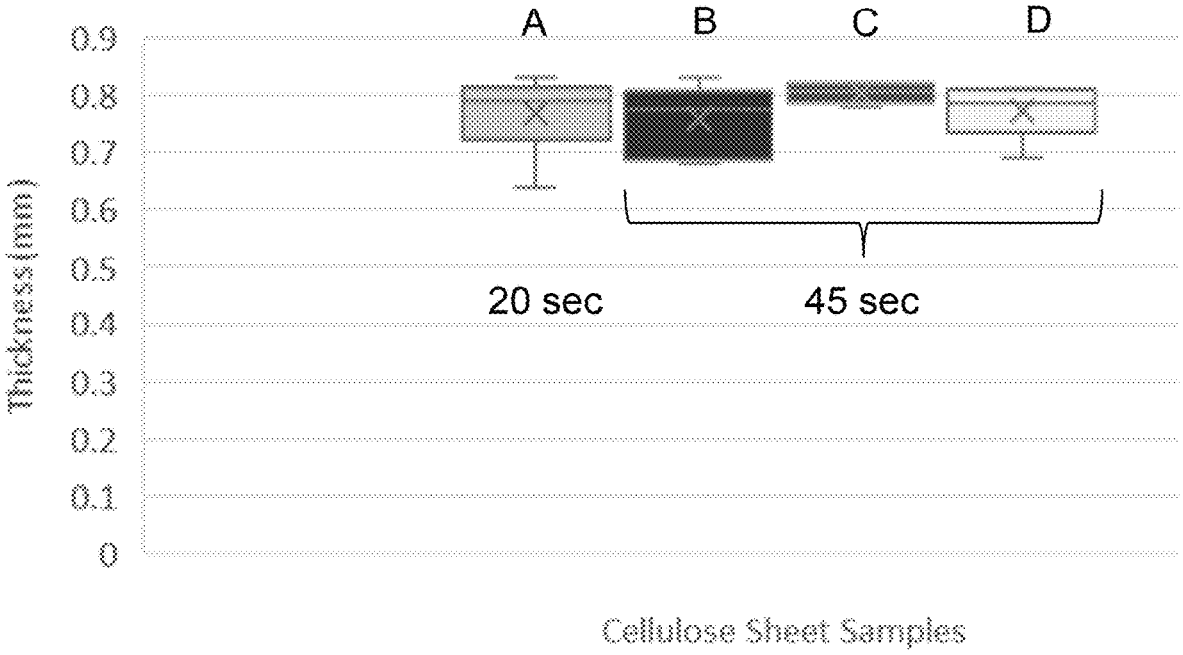
FIG. 9B is a chart of paper thickness for varied blending times.

To identify the existing variation within the straw pertaining to the thickness the sheets before it was rolled into a straw, a digital caliper was used to record the thickness of four different sheets, three of which were blended for 45 seconds and one that was blended for 20 seconds, shown in FIG. 9A. Six measurements were made one inch apart per sheet and the measurements recorded in millimeters as shown in Table 2. A box and whiskers plot shown in FIG. 9B demonstrates the degree of thickness uniformity.

TABLE 2

| Measurement location | A 20 seconds | B 45 seconds | C 45 seconds | D 45 seconds |
|---|---|---|---|---|
| 1 | 0.75 | 0.68 | 0.78 | 0.79 |
| 2 | 0.78 | 0.77 | 0.82 | 0.81 |
| 3 | 0.83 | 0.83 | 0.81 | 0.69 |
| 4 | 0.64 | 0.80 | 0.82 | 0.75 |
| 5 | 0.81 | 0.78 | 0.79 | 0.81 |
| 6 | 0.80 | 0.69 | 0.80 | 0.78 |
| mean | 0.77 | 0.76 | 0.80 | 0.77 |
| standard deviation | 0.06 | 0.06 | 0.01 | 0.04 |

Figure 10:
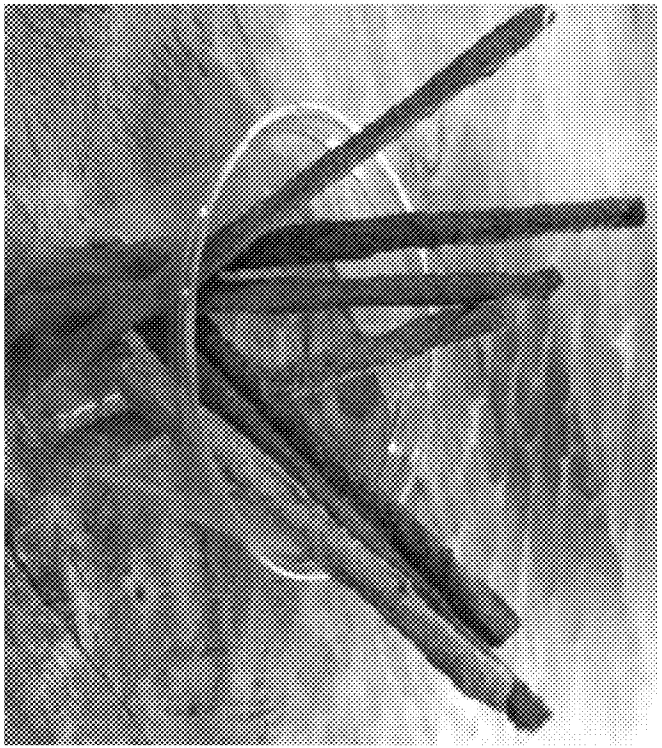
FIG. 10 is a photograph of paper straws made according to one example described herein.

Food coloring was added during the blending pulp phase of production to prepare pulp of different colors. The sheets and straws were made according to above methods. The resulting straws maintained the added color. The colored straws were more visually appealing as shown in FIG. 10.

Various examples of the invention have been described herein. It should be recognized that these examples are merely illustrative of the present invention. Variations of those preferred examples may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated or otherwise clearly contradicted by context.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain examples, the present invention is not limited to the particular examples disclosed, but is intended to cover modifications that are within the spirit and scope of the invention.

What is claimed is:

1. A method of making a paper product comprising:
obtaining corn husks;
extracting cellulose fiber pulp from the corn husks, wherein extracting cellulose fiber pulp comprises:
contacting the corn husks with a sodium carbonate solution in a vessel to form a corn husk mixture;
heating the corn husk mixture;
separating the corn husks from the corn husk mixture;
washing the separated corn husks with a first solvent;
combining the washed corn husks with a second solvent;
cutting the washed corn husks to create a liquid suspension of cellulose fiber pulp; and
separating the cellulose fiber pulp from the liquid of the suspension;
forming a paper sheet from the extracted cellulose fiber pulp;
adding a chitosan acetic acid solution having a concentration of at least 5 wt. % chitosan to the paper sheet;
forming the paper product from the paper sheet; and
coating the paper product with a paraffin wax.

2. The method of claim 1, wherein the corn husk mixture is heated to a temperature of at least 95° C.

3. The method of claim 1, wherein the first solvent or the second solvent comprises water.

4. The method of claim 1, wherein a weight ratio of the second solvent to washed corn husks is from 40:60 to 60:40.

5. The method of claim 1, further comprising adding a dye or a color additive to the liquid suspension.

6. The method of claim 5, wherein the dye or the color additive is a food-safe additive.

7. The method of claim 1, wherein the chitosan acetic acid solution is added by spraying or dipping the paper sheet.

8. The method of claim 1, wherein forming the paper sheet comprises:
adding the cellulose fiber pulp to a mold;
applying pressure to the cellulose fiber pulp; and
dehydrating the cellulose fiber pulp to form the paper sheet.

9. The method of claim 8, wherein the mold comprises a deckle.

10. The method of claim 8, wherein the mold comprises a mesh screen.

11. The method of claim 8, wherein the mold is placed over a water surface.

12. The method of claim 8, further comprising adding one or more absorbent layers to the sheet.

13. The method of claim 8, further comprising leveling the cellulose fiber pulp in the mold.

14. The method of claim 1, wherein forming the paper product comprises:

cutting the paper sheet to dimension;

shaping the paper sheet into the formed paper product; and drying the formed paper product.

15. The method of claim 14, wherein shaping the paper sheet comprises rolling the sheet on a form.

16. The method of claim 14, wherein the paper sheet has a thickness of 0.5 mm to 1.0 mm.

17. The method of claim 1, wherein the paper product is a tube.

18. The method of claim 17, wherein the tube is a drinking straw.

19. A paper product produced by the method of claim 1.

* * * * *